United States Patent [19]

Kaneko

[11] 4,241,899

[45] Dec. 30, 1980

[54] LIFTING JACK WITH LOCKING DEVICE

[75] Inventor: Kazumasa Kaneko, Fuji, Japan

[73] Assignee: Yasui Sangyo Co., Ltd., Fujinomiya, Japan

[21] Appl. No.: 1,528

[22] Filed: Jan. 8, 1979

[30] Foreign Application Priority Data

Jan. 11, 1978 [JP] Japan ..... 53-1820[U]

[51] Int. Cl.[3] ..... B66F 5/04

[52] U.S. Cl. ..... 254/8 B; 254/DIG. 3

[58] Field of Search ..... 254/DIG. 3, 2 R, 2 B, 254/2 C, 8 R, 8 B, 8 C

[56] References Cited

U.S. PATENT DOCUMENTS

| | | | |
|---|---|---|---|
| 3,664,635 | 5/1972 | Kincaid | 254/8 B |
| 4,131,263 | 12/1978 | John | 254/8 B |

*Primary Examiner*—Robert C. Watson

*Attorney, Agent, or Firm*—Zarley, McKee, Thomte, Voorhees & Sease

[57] ABSTRACT

A lifting jack is disclosed which is operated by a handle which is pumped up and down in order to lift a lifting platform on which is supported a load. A locking device is provided which, when the handle is pivoted into the fully upright position, automatically locks the handle upright; and which can be released by a simple blow from the foot of the operator.

1 Claim, 4 Drawing Figures

LIFTING JACK WITH LOCKING DEVICE

The present invention concerns a lifting jack of the fluid pressure type, such as one used for lifting motorcars and the like for the purposes of inspection and/or repair. More particularly, it is related to a locking device for keeping the actuating handle of the jack in a vertical position.

In this sort of jack, a hydraulic pressure cylinder is mounted in the main body, and the piston rod of this hydraulic pressure cylinder is pivoted to a proper part of a support arm which is pivoted to the body. Thus, when the piston rod is driven out of the hydraulic cylinder, the arm is made to rotate about its axis in the body of the jack, and thus its free end is raised. This driving of the piston rod out of the hydraulic pressure cylinder is performed by a hydraulic pump, which pumps hydraulic fluid into the cylinder. When it is desired to lower the free end of the support arm, which of course is used to support an automobile or the like, a release valve is opened which releases the fluid in the hydraulic pressure cylinder, and thus the piston rod is allowed to return into the hydraulic pressure cylinder, and the support arm rotates back around its axis to the position where its free end is in the lower position.

The hydraulic pump is actuated by a handle which is pivoted to the main body of the jack around a horizontal axis, and which, when pumped up and down, thus forces fluid from the pump into the fluid pressure cylinder.

In this kind of jack the handle is usually rather long, and it during use projects backwards and upwards from the body of the jack. When so projecting, the handle is rather obstructive, and gets in the way of people who are passing by the work, and indeed interferes with other work. Therefore, when the jack is not being used, or when it is supporting a vehicle on which work is being done, it is usual to keep the jack handle vertical, or to remove it altogether from the main body of the jack, by its being provided with a demounting mechanism.

Providing the handle with a demounting mechanism, so that the handle may be completely removed from the body of the jack except when it is being used to operate the pump, has several disadvantages. For instance, it is not always easy to attach and to remove the handle. Furthermore, the handle when removed may easily be lost or misplaced. This, then, is not a good solution to the problem of the protruding and inconvenient handle, and usually the solution which is adopted is to keep the jack handle in the vertical position.

However, in conventional jacks, when the handle is kept vertical when not being used, if the center of gravity of the handle is displaced a little to the rear of the jack, so far as to be rearward of the pivot axis of the handle, this may well be sufficient to make the handle lean over further, and thereby inconvenience, and even a potentially dangerous accident, may be caused. Thus, only by a part of a worker's body touching the handle slightly, the handle may fall over backwards.

Therefore it is an object of the present invention to provide a handle locking device which, in a garage jack of the above outlined construction, locks the handle automatically in the vertical position, when it is pivoted upright, and which has an easy action and is simple in construction and cheap and easy to make.

It is a further object of the present invention to provide such a locking device which can easily be operated by the foot of a workman, so as to unlock the handle and allow it to be again moved up and down to raise the jack.

According to the present invention, these and other objects are accomplished by a hydraulic lifting jack, comprising: a frame; an elevator pivotally mounted on the frame; a hydraulic cylinder mounted on the frame for lifting the elevator; a reservoir for hydraulic fluid; a hydraulic pump system for the hydraulic cylinder; and a handle, pivoted on the frame, for operating the pump system; characterised by: a handle locking device, comprising: a stop member which is adapted to pivot on the frame between a first position where it does not interfere with the handle, and a second position where it contacts the handle, when the handle is positioned in the upright position, at its lower end portion, so as to lock the handle; a lever for pivoting the stop member; and a spring means which urges the lever in the direction to urge the stop member to the second position.

Other objects, features, and advantages of the present invention will become clear from the following description of a preferred embodiment, taken in conjunction with the accompanying drawings, which are however for illustration only, and are not to be taken as limiting the scope of the present invention, which is to be defined only by the appended claims. In the drawings:

Figure 1:
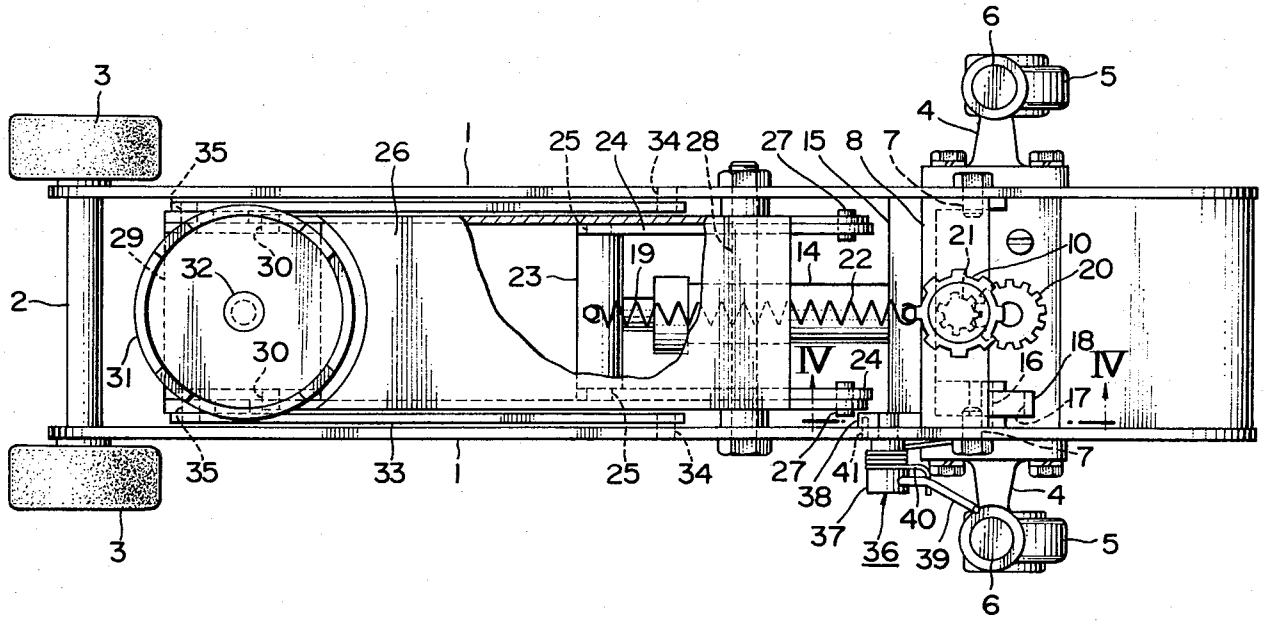
FIG. 1 is a part-sectional plan view of an embodiment of a garage jack according to the present invention.
Figure 2:
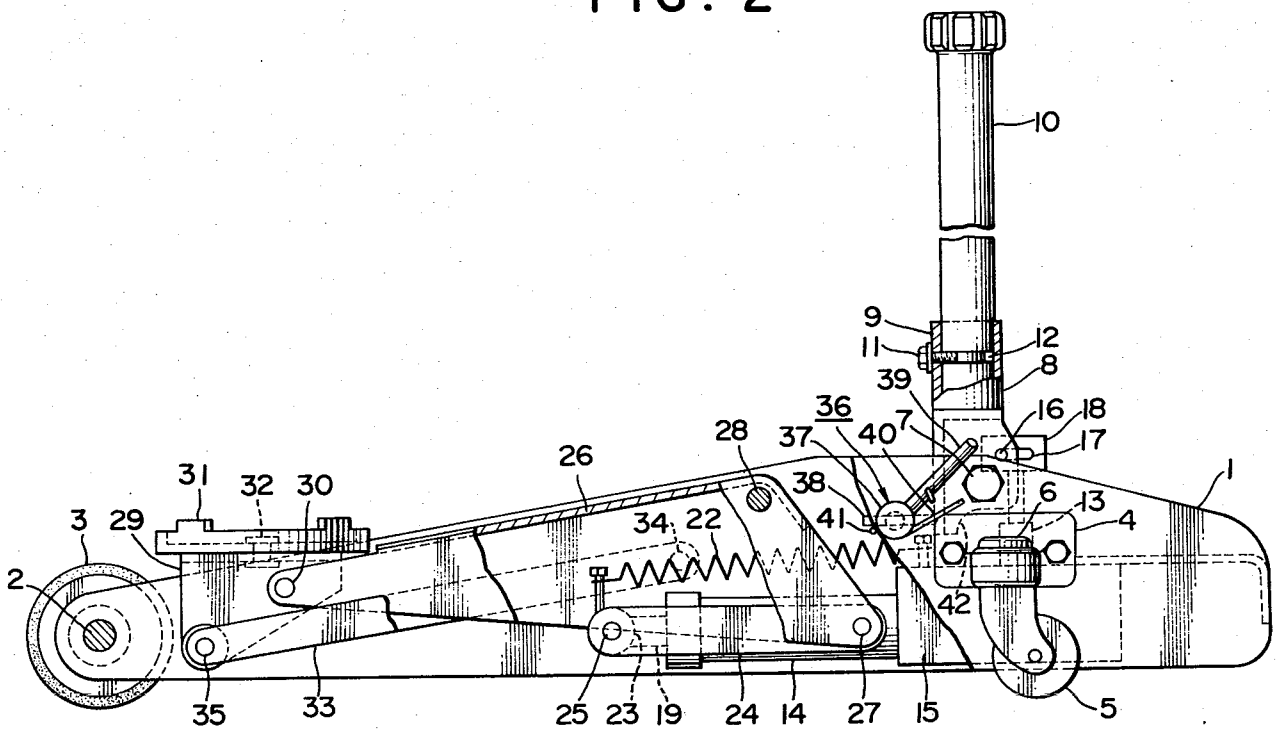
FIG. 2 is a part-sectional side view of the jack of FIG. 1.

Referring now to the drawings, and especially FIGS. 1 and 2, 1, 1 denote two side plates of the garage jack of the present invention, which are arranged as parallel to one another, run in a front-to-back direction, and form the main body frame of the jack. At their front end portions left and right hand wheels 3 are pivoted by wheel axles. On the outside faces of these side plates 1, at their rear end portions, brackets 4,4 are mounted, and on these brackets 4, around vertical axles 6, are attached rotatable casters 5 so as to be rotatable around vertical axles 6.

Further, in the rear end portions of side plates 1, the handle fork 8 is pivoted at its right and left hand sides by left and right handle axles 7, 7. Socket pipe 9 is formed as a part of handle fork 8, and into socket pipe 9 is inserted the lower end of a pipe or rod-like handle 10, which is used for pumping up the jack and raising and lowering vehicles or other loads. The handle 10 is retained into the socket pipe 9 by a removable bolt 11 which is inserted through the wall of socket pipe 9 into a ring-shaped groove 12 cut into the lower end of handle 10 around its periphery. Thus the handle 10 is fixed into the socket pipe 9 so as not to be able to move with respect to it around any horizontal axis, when the jack is in the position shown in FIG. 2; but it is to be noted that the handle may rotate about its own longitudinal axis with respect to the socket pipe 9, on account of the provision of the ring groove 12.

Between the rear portions of side plates 1, 1 is fixed a fluid reservoir 15, and this is provided with a pump 13 on its upper side and a fluid pressure cylinder in the center of its front-facing face.

The pump 13 has a plunger not designated by any reference numeral projecting from its upper face, and at the end of this plunger is fixed a cam plate 18, which has a long slot 17 formed in it as running from front to rear of the jack. Into this slot 17 is inserted a axle 16 running from left to right, which is fixed in an appropriate part of the handle fork 8. Thus, when the upper end of the handle 10 is moved to and fro, the handle fork 8 is pivoted about the handle axles 7, and the axle 16 slides to and fro in a cam fashion in the slot 17, and thus works the plunger of the pump 13 in and out. Thus the pump 13 is operated. By this pump action hydraulic fluid such as oil is pumped from the fluid reservoir 15 into the hydraulic pressure cylinder 14, and therefore the piston rod 19 of the hydraulic pressure cylinder 14 is driven out.

Further, in fluid reservoir 15, there is provided an escape valve, which allows the fluid in the fluid pressure cylinder 14 to escape. This escape valve is attached to and is operated by the bevel gear 20 which projects from the upper face of the fluid reservoir 15, and, regardless of the angle to which the handle 10 is positioned, this bevel gear 20 is in mesh with another bevel gear 21 which is fixed to the lower extremity of the handle 10. Thus, by turning handle 10 in the appropriate direction about its longitudinal axis, via the meshing of the bevel gears 20 and 21, the fluid escape valve may be opened or closed at will; and this can be performed, no matter at what position is the handle 10.

When the escape valve is opened by turning handle 10, so as to allow the piston rod 19 to return into the hydraulic pressure cylinder 14, this piston rod is surely and positively forced into the hydraulic pressure cylinder by the action of a tension coil spring 22, which is stretched between a pin attached to fluid reservoir 15 or to another appropriate part of the frame of the jack, and the linking bar 23, which is described below.

At the front end of piston rod 19 is fixed the linking bar 23, and tension bars 24 are provided which reach towards the rear of the jack from both ends of the linking bar 23, to which they are pivoted. At the rear ends of tension bars 24 they are pivoted to the rear lower ends of arms 26 by pins 27. The pivoting of linking bar 23 to tension bars 24 is made via horizontal pins 25.

The arms 26 are pivoted at their rear upper portions to the side plates 1 of the jack by right and left hand ends of axle 28, at the center upper part of the side plates 1. These arms 26 constitute the main portion of the raising arm of the jack as a whole. The support member 29 is pivoted to the front ends of arms 26 around a horizontal axis 30. At the upper portion of support member 29 a dish-shaped support element 31 is pivoted about a rotary axis 32. This support element 31 is adapted in a well-known fashion so as to be able to support vehicles, or the like, or other objects to be lifted. The rotary axis 32, as will be seen hereinafter, is constrained to be always vertical.

Link bars 33 are provided, which at their forward ends are pivoted to support member 29 at its lower end by pin 35, and at their rear ends are pivoted to the left and right side plates 1 at their central upper portions by pins 34. Thus a parallelogram-like structure is provided by link bars 33, side plates 1, support member 29, and arms 26, and thereby the support member 29 is constrained always to be in the same orientation.

Thus, to summarize the operation of this jack, when the handle 10 is pivoted to and fro about axis 7, the pump 13 is actuated, and therefore piston rod 19 is driven out of hydraulic pressure cylinder 14. Thereby arms 26 are pivoted clockwise as seen in FIG. 2 about the axle 28, and thereby motorcars, other vehicles, or the like, charged upon the dish-shaped support element 31, are lifted up.

Again, when the handle 10 is twisted about its longitudinal axis, through the medium of the bevel gears 20 and 21, the escape valve in the fluid reservoir 15 is opened, and thereby hydraulic fluid in the hydraulic pressure cylinder 14 is allowed to return to the fluid reservoir 15. This allows the piston rod 19 to re-enter into the hydraulic pressure cylinder 14, and thereby the arms 26 are let down in an anti-clockwise direction as seen in FIG. 2, and the load charged upon the dish-shaped support element 31 is lowered.

Figure 3:
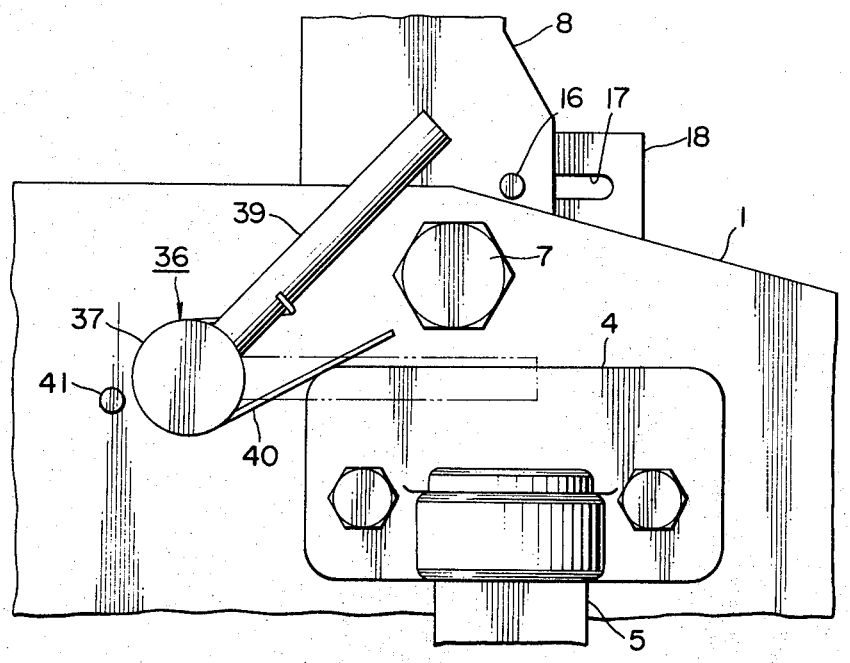
FIG. 3 is an enlarged side view of part of the jack of FIGS. 1 and 2, showing the main parts of the locking device of the present invention.
Figure 4:
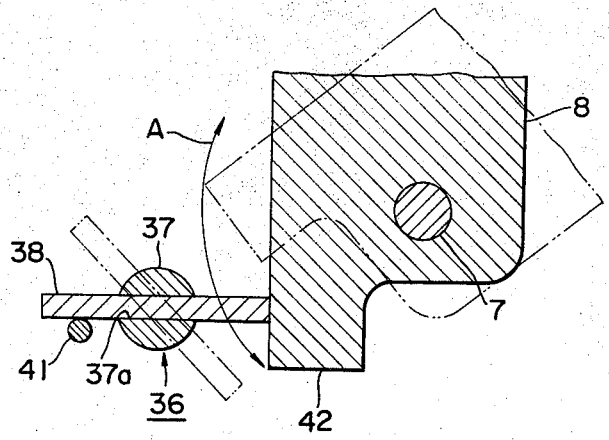
FIG. 4 is a rather schematic side view of parts of the locking device shown in FIG. 3, seen as a section along the line IV—IV in FIG. 1.

36 denotes a locking device which is constructed so as to lock the handle 10 in the upright position. As shown in FIGS. 3 and 4, this locking device 36 is composed of lock pin 37, stop 38, operator lever 39, spring 40, and stop pin 41.

Lock pin 37 is pivoted at a position in one of side plates 1 a little ahead to the front of handle axle 7. The left and right hand ends of lock pin 37 project out past side plate 1. Stop 38 is formed as a sort of flat board member, and it is inserted into a slot **37*a* cut in the inside end of lock pin 37, so as to run generally in a front-to-back direction in the jack. Thus stop 38 is rotated together with lock pin 37**.

On handle fork 8, at the one side of it at a lower front portion, is formed a projection 42. This is so arranged that when lock pin 37 and stop 38 are in a certain position the rear edge of stop 38 is in contact with the front edge of projection 42, and thereby the handle 10 will be held in the upright position. In detail, the assembly of lock pin 37 and stop 38 is rotatable between a first position, shown by phantom lines in FIG. 4, wherein stop 38 does not interfere with movement of handle 10, i.e. does not contact projection 42, and a second position (wherein in fact stop 38 is almost level) shown by solid lines in FIG. 4, wherein by the rear edge of stop 38 contacting the front edge of projection 42 the handle 10 is maintained in the upright position, and is positively prevented from leaning over backwards.

The operator lever 39 is attached to the lock pin 37, close to the side plate 1, on its outwardly projecting end, and projects to the rear and upwards. Spring 40, in the embodiment shown in the figures, is a coil spring which is wound around lock pin 37, between the side plate 1 and the operator lever 39, and one end of which is hooked around the operator lever 39, while the other end bears against the front upper corner of the bracket 4. Thus, by the action of this spring 40, the assembly composed of lock pin 37, stop 38, and operator lever 39 is urged in the anti-clockwise direction in FIGS. 3 and 4, i.e. towards the second position as defined above, wherein the handle is locked.

This anti-clockwise motion of the above assembly is limited by the stop pin 41, which is attached to and projects out of the side plate 1, on its inner side, a little ahead of the lock pin 37, and which prevents any motion of the assembly past the second position, by the stop 38 coming into contact with it.

The above-described locking device operates as follows. When the handle 10 is rotated about axles 7 to the fully upright position, from a position in which it is inclined backwards, the projection 42 which is integral with the handle fork 7 pushes and presses downwards the upper rear face of the stop 38 by making stop 38 turn in a direction clockwise in FIGS. 3 and 4, against the resistance of the spring 40. When the handle 10 reaches the fully upright position, the rear corner of projection 42 just clears the end of stop 38, and therefore by the action of the spring 40 the stop 38 and the lock pin 37 are returned to the second position, shown by solid lines in FIG. 4, wherein the front edge of the projection 42 is in contact with the rear edge of stop 38. Thus the handle is prevented from rotating back in a counterclockwise direction, and is locked erect.

Further, in the above embodiment, the handle 10 is not able to pivot forwards from the erect position, because of the configuration of the slot 17 in the cam plate 18, which prevents it. Thus the handle is positively locked upright.

To release the locking device, and to allow the handle once again to be moved, it is only necessary to step on the end of the operator lever 39, by foot if desired. Thus the stop 38 is moved to the position shown in FIG. 4 by the phantom lines, i.e. the first position. In this position the projection 42 of the handle fork 8 is free to rotate at will about the axles 7, along with the handle 10.

As indeed will be understood from the above, with the lock device according to the present invention, when the jack is not being used, by merely moving the handle up to the erect position, it is automatically locked. Therefore it is not possible to forget accidentally to operate the locking device. So there is no possibility that by careless mistake when the jack is not in use the handle 10 should fall down to the rear, and perhaps obstruct passage of workmen, interfere with work in progress, or even cause a dangerous accident. Thus the beneficial results of this invention are clearly apparent.

It is also seen that the locking device of the present invention is very simple in construction, and can readily be adapted to a wide range of lifting jacks. Also, its operation for disengagement is very easy, as a simple kick from the foot of the operator is sufficient to release the handle. Further, as stated above, its operation is automatic, merely requiring that the handle should be pivoted up to the erect position. It should be noted that, in practice, there is no danger of locking the handle accidentally when using the jack, since the pumping action of the handle which is performed when jacking up a vehicle or the like does not normally ever bring the handle to the fully upright position.

The locking device as described above can be adapted to various jacks, not only vehicle jacks. Further, various changes are possible in the manner in which the present invention is embodied. For instance, the lever 39 could be replaced by a step-on pedal, or the spring 40 could be changed to a compression coil spring provided between operator lever 39 and bracket 4. Various other changes are also possible in the form and the detail of the embodiment, without departing from the scope of the present invention; and therefore it is desired that this scope, rather than being determined by any details of the embodiment given, or of the drawings, which were given for illustration only, should instead be determined only by the scope of the appended claim.

What is claimed is:

1. A hydraulic lifting jack, comprising: a frame; an elevator pivotally mounted on the frame; a hydraulic cylinder mounted on the frame for lifting the elevator; a reservoir for hydraulic fluid; a hydraulic pump system for the hydraulic cylinder; and a handle, pivoted on the frame, for operating the pump system; characterized by:

a handle locking device, comprising:

a stop member which is adapted to pivot on the frame between a first position where it does not interfere with the handle, and a second position where it contacts the handle, when the handle is positioned in the upright position, at its lower end portion, so as to lock the handle;

a lever for pivoting the stop member; and a spring means which urges the lever in the direction to urge the stop member to the second position.

* * * * *